US010274197B2

(12) United States Patent
Scarborough et al.

(10) Patent No.: US 10,274,197 B2
(45) Date of Patent: Apr. 30, 2019

(54) TAPE DISPENSING DEVICE

(71) Applicants: Todd Scarborough, Fort Smith, AR (US); Glenda June Goff, Fort Smith, AR (US)

(72) Inventors: Todd Scarborough, Fort Smith, AR (US); Glenda June Goff, Fort Smith, AR (US)

( * ) Notice: Subject to any disclaimer, the term of this patent is extended or adjusted under 35 U.S.C. 154(b) by 421 days.

(21) Appl. No.: 15/137,414

(22) Filed: Apr. 25, 2016

(65) Prior Publication Data

US 2016/0327268 A1 Nov. 10, 2016

Related U.S. Application Data

(60) Provisional application No. 62/158,039, filed on May 7, 2015.

(51) Int. Cl.

| | |
|---|---|
| ***F23Q 2/32*** | (2006.01) |
| ***B65H 35/00*** | (2006.01) |
| ***B65H 75/10*** | (2006.01) |

(52) U.S. Cl.

CPC ..... *F23Q 2/32* (2013.01); *B65H 35/0026* (2013.01); *B65H 75/10* (2013.01); *B65H 2701/533* (2013.01)

(58) Field of Classification Search

CPC ..... F23Q 2/32; B65H 35/0026; B65H 75/10; B65H 2701/533

See application file for complete search history.

(56) References Cited

U.S. PATENT DOCUMENTS

| | | | | |
|---|---|---|---|---|
| 2,652,205 | A * | 9/1953 | Balaban | A47L 25/005 15/104.002 |
| 4,560,344 | A | 12/1985 | Kietaibl | |
| 4,854,856 | A | 8/1989 | Steiger, Jr. et al. | |
| 5,181,847 | A | 1/1993 | Da Silva | |
| 5,328,115 | A * | 7/1994 | Samuelson | B65H 35/002 206/411 |
| 5,580,239 | A * | 12/1996 | Jang | B43K 29/16 401/195 |
| 6,382,481 | B1 | 5/2002 | McIlmoil | |
| 2002/0166238 | A1 | 11/2002 | Kaufer | |

* cited by examiner

*Primary Examiner* — Alfred Basichas
(74) *Attorney, Agent, or Firm* — Global Intellectual Property Agency, LLC; Daniel Boudwin

(57) ABSTRACT

A tape dispensing device for disposal around a cigarette lighter. The present invention includes a tubular support defining a central opening and on which a roll of tape is wound, such as a roll of duct tape. The device further includes a lighter having a body in which fuel is stored and an ignition source on an upper end thereof that is removably positionable within the central opening of the tubular support. The body of the lighter is secured to the periphery of the central opening of the tubular support via a press fit. In some embodiments, the roll of tape is wound directly on the body of the lighter without the use of the tubular support. The present invention eliminates the need to carry the two products separately, which saves time and frustration and prevents people from becoming stranded without adhesive tape.

5 Claims, 4 Drawing Sheets

TAPE DISPENSING DEVICE

CROSS REFERENCE TO RELATED APPLICATION

This application claims the benefit of U.S. Provisional Application No. 62/158,039 filed on May 7, 2015. The above identified patent application is herein incorporated by reference in its entirety to provide continuity of disclosure.

BACKGROUND OF THE INVENTION

The present invention relates to combination lighter devices. More specifically, the present invention provides a combination lighter and tape dispensing device.

Many people carry lighters on their person when performing various activities such as camping, hunting, fishing or rendering professional services. Further, many of these same people require the use of duct tape to successfully fulfill various tasks. Unfortunately, most individuals remember to carry either a lighter with them or a roll of duct tape, but not both. Further, some people may throw a roll of duct tape in a toolbox, but this can create clutter and take up valuable space. Therefore, there exists a need in the prior art for device having both a lighter and roll of tape combined for providing convenient access to both.

Devices have been disclosed in the prior art that relate to combination lighter devices. These include devices that have been patented and published in patent application publications. These devices generally relate to lighters combined with secondary objects, such as U.S. Patent Application Publication Number 2002/0166238, U.S. Pat. No. 4,560,344, U.S. Pat. No. 6,382,481, U.S. Pat. No. 4,854,856, and U.S. Pat. No. 5,181,847.

These prior art devices have several known drawbacks. Some devices provide a survival device comprise packages of tape in a combination with materials for making fires. However, these devices fail to provide a cigarette lighter secured within an adhesive tape dispenser.

In light of the devices disclosed in the prior art, it is submitted that the present invention substantially diverges in design elements from the prior art and consequently it is clear that there is a need in the art for an improvement to existing combination lighter devices. In this regard the instant invention substantially fulfills these needs.

SUMMARY OF THE INVENTION

In view of the foregoing disadvantages inherent in the known types of tape dispensing devices now present in the prior art, the present invention provides a new tape dispensing device wherein the same can be utilized for providing convenience for the user when carrying a roll of tape and lighter on their person.

It is therefore an object of the present invention to provide a new and improved tape dispensing device that has all of the advantages of the prior art and none of the disadvantages. The present invention includes a tubular support defining a central opening and on which a roll of tape is wound, such as a roll of duct tape. The device further includes a lighter having a body in which fuel is stored and an ignition source on an upper end thereof that is removably positionable within the central opening of the tubular support. In some embodiments, the roll of tape is wound directly on the body of the lighter without the use of the tubular support. The body of the lighter is secured to the periphery of the central opening of the tubular support via a press fit.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
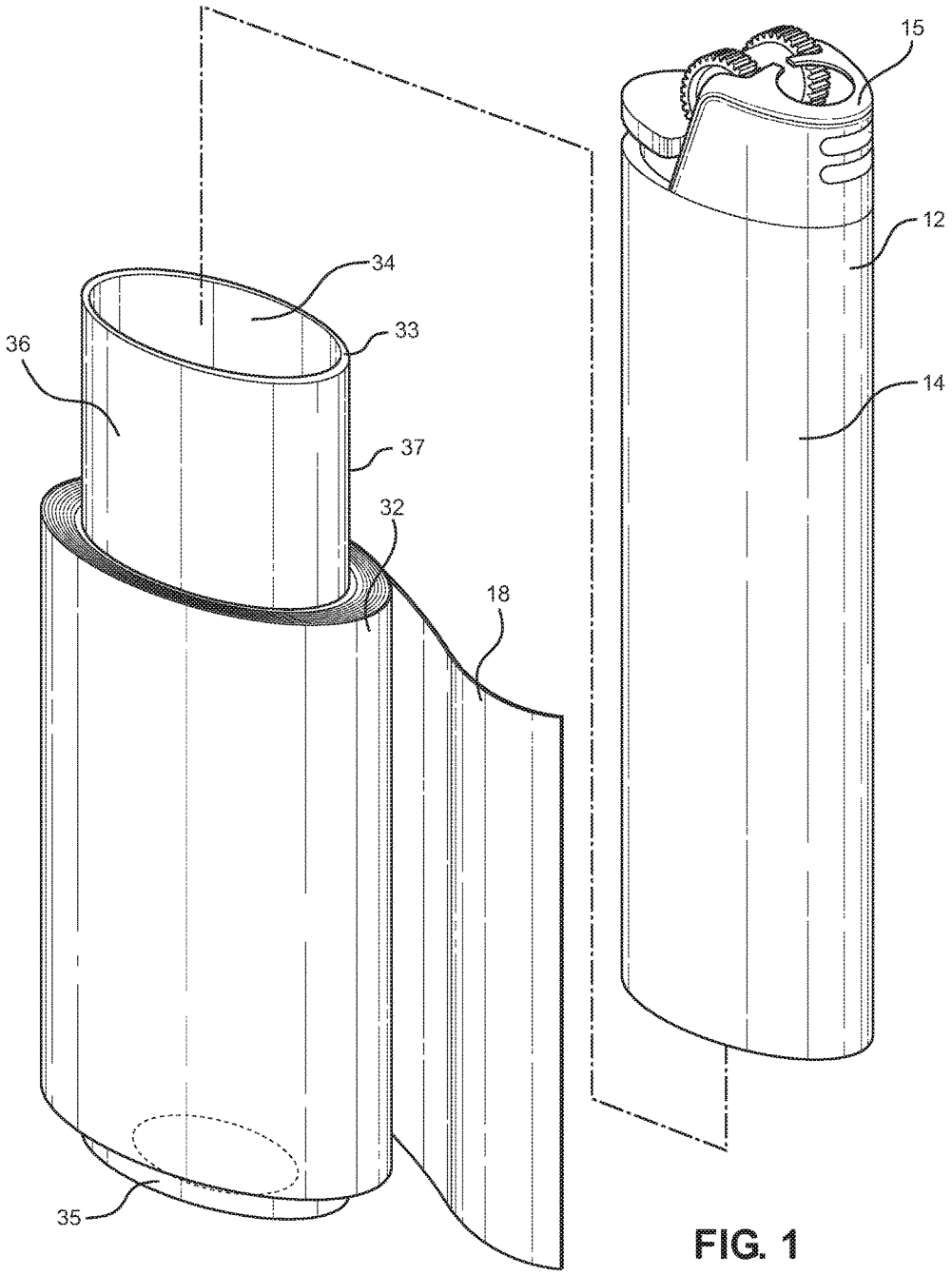
FIG. 1 shows a perspective view of the tape dispensing device.

Reference is made herein to the attached drawings. Like reference numerals are used throughout the drawings to depict like or similar elements of the tape dispensing device. For the purposes of presenting a brief and clear description of the present invention, the preferred embodiment will be discussed as used for carrying a roll of tape and a lighter on a user's person. The figures are intended for representative purposes only and should not be considered to be limiting in any respect.

Figure 2:
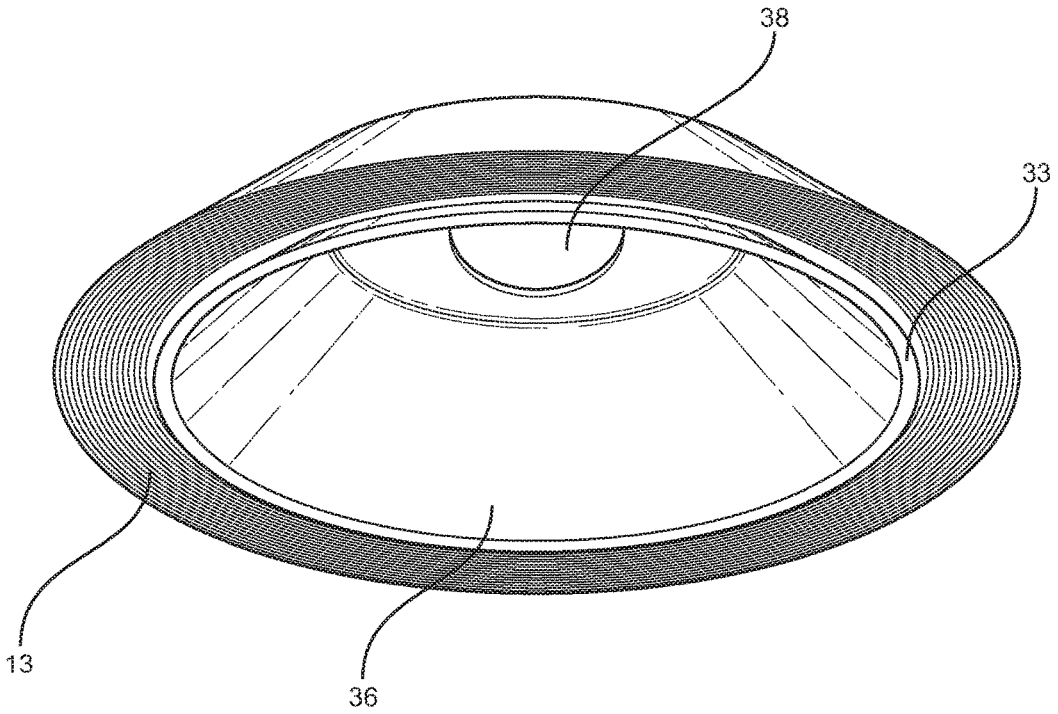
FIG. 2 shows a top perspective view of an embodiment of the tape dispensing device.

Referring now to FIGS. 1 and 2, there are shown perspective views of an embodiment of the tape dispensing device. The tape dispensing device 11 comprises a tubular support 36 defining a central opening 34 and on which a roll of tape 13 is wound. In the illustrated embodiment, the tubular support 34 comprises a lower wall 35, and a sidewall 37 extending upward therefrom, and an open upper end 33, defining the central opening 34. The central opening 34 is configured to receive a cigarette lighter 12, preferably via a press fit. The cross sectional shape of the sidewall 37 of the tubular support 36 corresponds to the cross sectional shape of a cigarette lighter 12. The lower wall 35 of the tubular support 36 comprises a planar surface for supporting the lighter 12 in an upright configuration on a horizontal support surface. The lower wall 35 further comprises an aperture 38 thereon for allowing a user to push the lighter 12 upwards through the central opening 34 for removal thereof.

The tape dispensing device 11 further comprises a roll of tape 13 wound or wrapped around the sidewalls 37 of the tubular support 36. The roll of tape 13 comprises an elongated, adhesive tape coiled in a roll formation. In the illustrated embodiment, the roll of tape 13 comprises a first end and a second end 18, wherein the first end is secured to the sidewall 37 of the tubular support 36. The second end 18 is coiled around the tubular support 36 until it is removably secured to exterior of the roll of tape 13. In the illustrated embodiment, the adhesive tape is duct tape. However, other types of tape may be used in other embodiments, such as double-sided tape, electrical tape, masking tape, surgical tape, among others. Further, the illustrated embodiment demonstrates that the roll of tape 13 disposed around the tubular support 36 can be of varying heights to account for different tape widths desired by the user.

In some embodiments, the tape dispensing device 11 further includes a cigarette lighter 12 having a body 14 in which fuel is stored and an ignition source on an upper end 15 thereof that is removably positionable within the central opening 34 of the tubular support 36. Preferably, the body 14 of the lighter 12 comprises a rounded shape so as to fit within the central opening 34 of the tubular support 36. The body 14 further defines a hollow interior to provide a fuel tank for the lighter 12. In some embodiments, any suitable fuel is disposed in the fuel tank, such as pressurized butane or the like. The top 15 of the lighter 12 is operably connected to the fuel tank via any suitable means, such as the top 15 comprising an aperture which is connectable with the fuel tank through a valve, not shown, and a manually actuated igniter means is positioned adjacent the aperture to ignite the fuel discharged from the aperture. The lighter 12 itself is only a portion of the claimed combination, and many equivalents can be substituted for the embodiment.

The lighter 12 is removably secured within the central opening 34 of the tubular support 36, preferably, via a press fit. In this way, once the lighter 12 is emptied, it can be removed from the tubular support 36 via force and replaced with a new lighter. However, in other embodiments, the lighter 12 is removably secured to the tubular support 36 via any suitable fastener.

Figure 3:
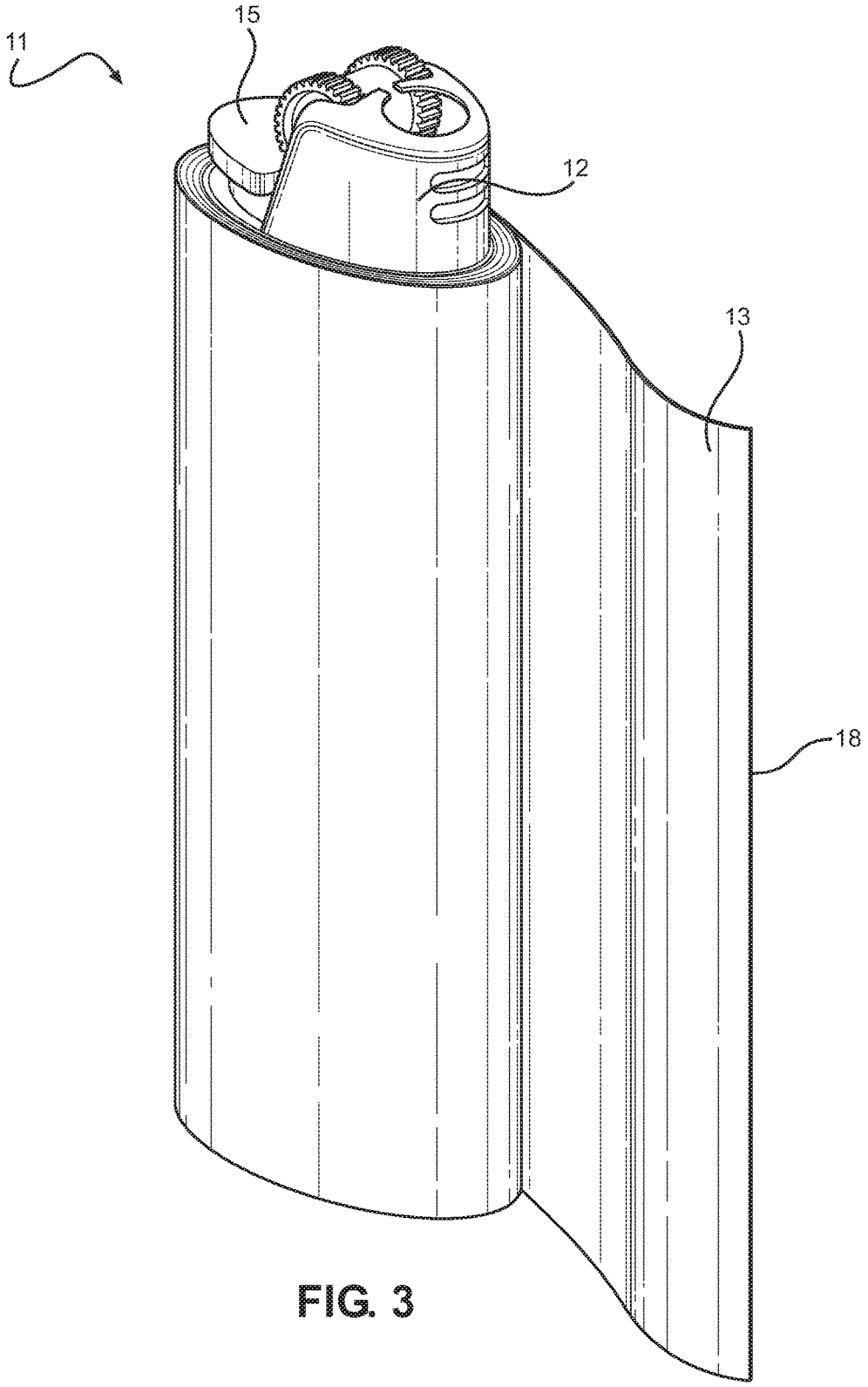
FIG. 3 shows a perspective view of an alternative embodiment of the tape dispensing device.
Figure 4:
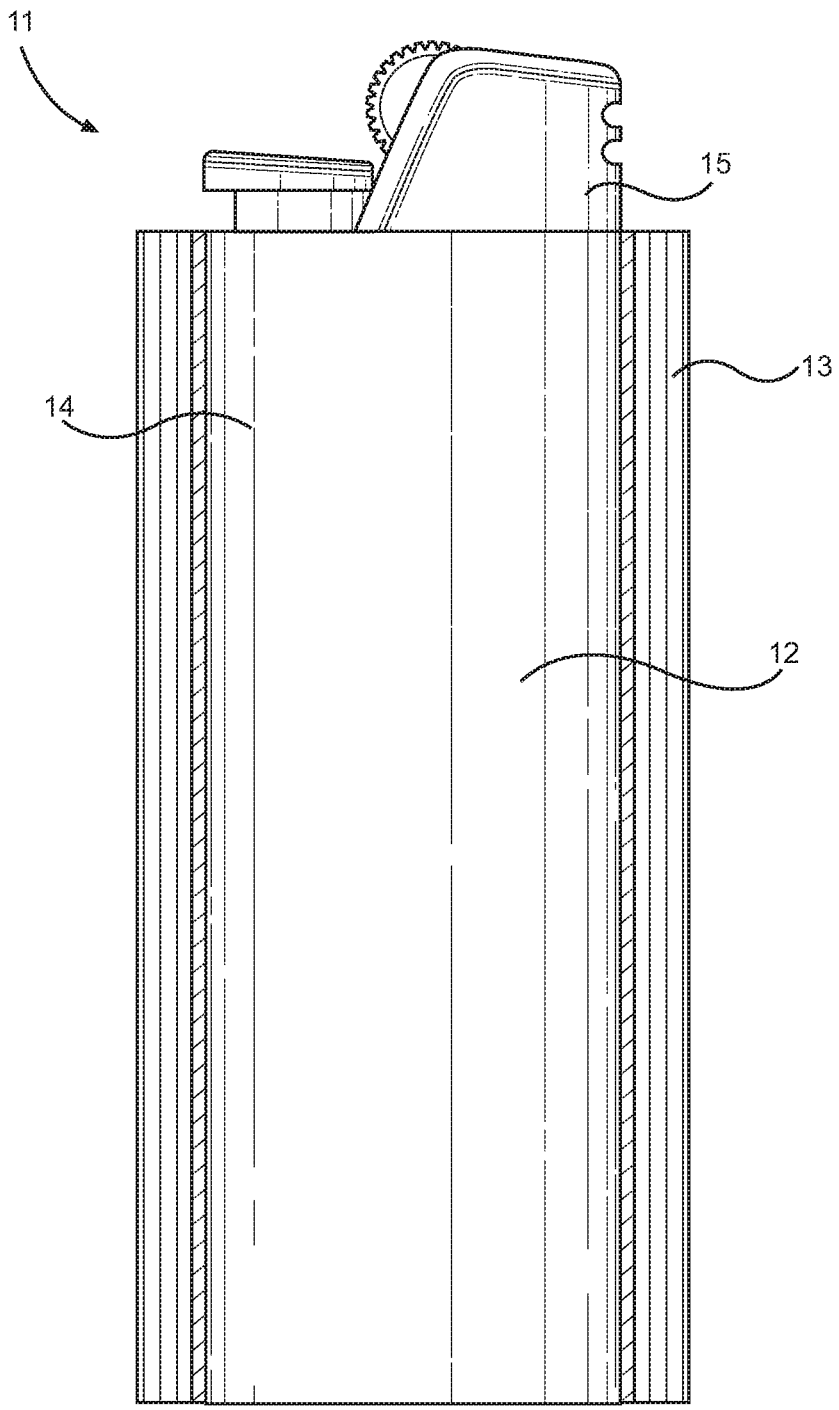
FIG. 4 shows a cross sectional view of an alternate embodiment of the tape dispensing device.

Referring now to FIGS. 3 and 4, there is shown a perspective view and a cross sectional view of an alternative embodiment of the tape dispensing device. In some embodiments, the roll of tape 13 is wound directly on the body 14 of the lighter 12 without the use of the tubular support. In the illustrated embodiment, the roll of tape 13 comprises a first end and a second end 18, wherein the first end is secured directly to the body 14 of the lighter 12. The second end 18 is coiled around the lighter 12 until it is removably secured to the exterior of the roll of tape 13. In this way, the lighter 12 is permanently secured to the roll of tape 13.

Preferably, the roll of tape 13 is disposed around the lighter 12 so as not to obstruct a user from accessing the upper end 15 of the lighter 12. The exterior of the roll of tape 13 comprises substantially the same shape as the body 14 of the lighter 12, however, the exterior of the roll of tape 13 is wider due to the one or more coiled layers disposed therearound. In the illustrated embodiment, the roll of tape 13 and the body 14 of the lighter 12 comprise a cross section having an oval shape.

In operation, the second end of the roll of tape 13 may be separated from the exterior thereof. The tape is uncoiled or unrolled until the desired length of tape is dispensed. A user may cut or rip the unrolled tape from the remaining roll of tape 13. In addition, the upper end 15 of the lighter 12 may be actuated in order to access a flame for lighting a cigarette, a candle, or other tasks the user desires. The present invention eliminates the need to carry the two products separately.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tape dispensing device, comprising:

a tubular support having a lower wall, one or more sidewalls, and an open upper end, defining a central opening;

a roll of tape having a first end and a second end, wherein the first end is secured to the one or more sidewalls of the tubular support and the second end is coiled around the tubular support until the second end is removably secured to an exterior of the roll of tape;

wherein the central opening of the tubular support is configured to removably receive a cigarette lighter therein;

wherein the lower wall of the tubular support comprises an aperture configured to allow a user to push a cigarette lighter upwards through the open upper end of thereof.

2. The tape dispensing device of claim 1, further comprising a cigarette lighter having a body in which fuel is stored and an ignition source on an upper end thereof for producing a flame.

3. The tape dispensing device of claim 2, wherein the body of the cigarette lighter and the central opening of the tubular support comprise an oval shaped cross section.

4. The tape dispensing device of claim 2, wherein the cigarette lighter is removably positioned within the central opening of the tubular support via a press fit.

5. The tape dispensing device of claim 1, wherein the lower wall of the tubular support comprises a planar surface configured to support a cigarette lighter in an upright configuration when disposed on a horizontal support surface.

* * * * *